US012740649B2

(12) United States Patent
Ambuske et al.

(10) Patent No.: US 12,740,649 B2
(45) Date of Patent: Sep. 22, 2026

(54) COMFORTER BLANKET

(71) Applicant: Hest Corporation, Seattle, WA (US)

(72) Inventors: Aaron Alan Ambuske, Seattle, WA (US); Zac West, Seattle, WA (US); Mirona Motoc, Powell River (CA); Hedvig von Beetzen, Vashon, WA (US); Linsey Gardner, Seattle, WA (US)

(73) Assignee: Hest Corporation, Seattle, WA (US)

( * ) Notice: Subject to any disclaimer, the term of this patent is extended or adjusted under 35 U.S.C. 154(b) by 0 days.

(21) Appl. No.: 18/811,638

(22) Filed: Aug. 21, 2024

(65) Prior Publication Data

US 2025/0064221 A1 Feb. 27, 2025

Related U.S. Application Data

(60) Provisional application No. 63/534,417, filed on Aug. 24, 2023.

(51) Int. Cl.
*A47C 21/02* (2006.01)
*A47G 9/02* (2006.01)

(52) U.S. Cl.
CPC ..... *A47C 21/022* (2013.01); *A47G 9/0223* (2013.01)

(58) Field of Classification Search
CPC ..... A47G 9/02; A47G 9/0207; A47G 9/0238; A47G 9/0223; A47G 9/0261
See application file for complete search history.

(56) References Cited

U.S. PATENT DOCUMENTS 1,865,329 A * 6/1932 Mchorter ..... A47G 9/02 5/500
1,972,919 A * 9/1934 Chambless ..... A47C 21/022 5/498
2,729,831 A * 1/1956 Fuld ..... A47G 9/04 5/494
2,851,703 A * 9/1958 Greco ..... A47D 15/02 5/494
3,654,646 A * 4/1972 McMahon, Jr. ..... A47G 9/0246 5/482
3,824,640 A * 7/1974 Golden ..... A47G 9/0284 5/485
3,831,206 A * 8/1974 Geary ..... A47G 9/086 5/413 R
3,906,559 A * 9/1975 Bahr ..... A47G 9/0246 5/496

(Continued)

FOREIGN PATENT DOCUMENTS

FR 2837686 A1 * 10/2003 ..... A47G 9/0261
FR 2905580 A1 * 3/2008 ..... A47G 9/086

(Continued)

*Primary Examiner* — David E Sosnowski
(74) *Attorney, Agent, or Firm* — Lowe Graham Jones PLLC

(57) ABSTRACT

Embodiments are directed toward preventing misalignment of a comforter relative to a mattress. The comforter has a foot-end portion that defines a pouch. The foot-end portion of a mattress can be inserted into the foot-end portion of the pouch, thereby preventing misalignment of the comforter relative to the mattress while providing draft protection to the feet of a person sleeping on the mattress.

9 Claims, 13 Drawing Sheets

(56) References Cited

U.S. PATENT DOCUMENTS 4,757,832 A * 7/1988 Russell ..... A45F 4/02 5/413 R
4,862,533 A * 9/1989 Adams, III ..... A47G 9/086 5/413 R
5,189,744 A * 3/1993 Roberts ..... A47G 9/0246 5/497
5,640,725 A * 6/1997 Ando ..... A47C 27/128 5/413 AM
5,735,003 A * 4/1998 Judge ..... A47G 9/086 5/413 AM
6,041,456 A * 3/2000 Pharr ..... A47G 9/0246 5/497
6,134,730 A * 10/2000 Evanson ..... A47G 9/02 5/500
6,253,398 B1 * 7/2001 Yim ..... A47C 31/105 5/497
9,420,904 B1 * 8/2016 Russell ..... A47G 9/0238
10,786,100 B2 * 9/2020 Glavin ..... A47G 9/08
2007/0000053 A1 * 1/2007 Yang ..... A47C 31/105 5/493
2007/0151028 A1 * 7/2007 Bauer ..... A47G 9/0207 5/482
2007/0240262 A1 * 10/2007 Johnson ..... A47G 9/0223 5/498
2009/0178197 A1 * 7/2009 Swihart ..... A47G 9/02 5/502
2010/0058537 A1 * 3/2010 Schuck ..... A47C 21/028 5/493
2010/0242172 A1 * 9/2010 Lijesen ..... A47G 9/0246 5/413 R
2011/0113550 A1 * 5/2011 Lafoux ..... A47G 9/086 5/413 R
2012/0110736 A1 * 5/2012 Hall ..... A47G 9/0223 5/482
2012/0317723 A1 * 12/2012 Liversage ..... A47G 9/0246 5/497
2015/0020309 A1 * 1/2015 Pitchforth ..... A47G 9/086 5/413 AM
2018/0184819 A1 * 7/2018 Gaudyn ..... A47G 9/04
2020/0022512 A1 * 1/2020 Glavin ..... A47G 9/0223
2020/0060448 A1 * 2/2020 Boesch ..... A47C 31/105
2020/0128979 A1 * 4/2020 Hinman ..... A47G 9/0223
2021/0169244 A1 * 6/2021 Pope ..... A47G 9/02
2022/0133052 A1 * 5/2022 Adjesson ..... A47G 9/0223 5/498
2023/0078278 A1 * 3/2023 Russell ..... A47G 9/0261 5/485
2023/0131670 A1 * 4/2023 Kozak ..... A47D 15/008 5/413 R
2023/0276963 A1 * 9/2023 Kaisershot ..... A47G 9/04 5/498
2024/0156285 A1 * 5/2024 Latham ..... A47G 9/0223
2024/0156286 A1 * 5/2024 Pratola ..... A47G 9/0246

FOREIGN PATENT DOCUMENTS

GB 2440822 A * 2/2008 ..... A47G 9/08
GB 2549476 A * 10/2017 ..... A47G 9/04
JP H09234147 A * 9/1997
JP 3044615 B2 5/2000
JP 3146335 U * 11/2008

* cited by examiner

COMFORTER BLANKET

CROSS REFERENCE TO RELATED APPLICATION

This non-provisional application claims the benefit of the filing date of provisional application Ser. No. 63/534,417, filed Aug. 24, 2023, entitled COMFORTER BLANKET, under 35 U.S.C. § 119, the entirety of which is hereby incorporated herein by reference.

FIELD OF THE INVENTION

This application relates to comforters and, more particularly, to comforters that promote alignment with a corresponding mattress.

BACKGROUND OF THE INVENTION

Comforters are typically used as bedding on mattresses. When laid out on a mattress, a comforter can easily slide off the mattress or be pulled to one side of the bed by one of the occupants, thereby leaving an occupant of the bed without sufficient coverage. Many attempts have been made to solve this long-standing problem, but none of those proposed solutions prevent misalignment of the comforter to the mattress in a manner that provides draft protection while simultaneously supporting thermoregulation by enabling prevention of overheating of the occupants.

In one attempt, a strap similar to a belt is wrapped around the foot end of the mattress, and the strap has clips that grasp the comforter to secure it in position relative to the mattress (see JP 3044615). This approach, however, has several deficiencies. In particular, the strap fails to provide draft protection and instead enables cold air to flow under the mattress. This approach also subjects the occupants to feeling the belt-like strap while they sleep.

In another attempt, couplers secured to a fitted sheet couple a comforter to the perimeter of the fitted sheet (see U.S. Pre-Grant Publication No. 2010/0058537). This approach, however, requires orienting the fitted sheet in a single manner relative to the mattress. It also requires having a special fitted sheet to enable use of the comforter in this way.

Another approach has been to make a comforter that is usable as a sleeping bag by providing a draw cord in the quilt (U.S. Pre-Grant Publication No. 2020/0022512). This approach, however, requires a sleeping bag liner to keep it clean. This approach also fails to prevent an occupant from pulling the comforter to one side of the bed while the other occupant is not in the bed.

In a further approach, a band surrounds the peripheral sides of the mattress, and the comforter is then secured to the band (U.S. Pre-Grant Publication No. 2022/0133052). This approach, however, is difficult to transfer from one bed to another because the band is not easily removed and reinstalled. This approach also makes it difficult to use, replace, or clean the sheets on the bed.

In other environments, a sleeping pad can be slipped into a sleeping bag or a sleeve integrated in the sleeping bag. This approach, however, requires a sleeping bag liner to keep it clean. This approach also requires a sleeping pad designed for sleeping bags.

For these reasons, there is a need for solving the above long-standing problems, including preventing misalignment of a comforter with respect to a mattress. There is also a need for providing draft protection while enabling thermoregulation. There is a further need to enable use of the comforter with any mattress or sheets.

SUMMARY OF THE INVENTION

It is therefore an object of the present invention to provide a comforter system that provides for preventing misalignment of a comforter relative to a mattress.

It is also an object of the present invention to provide a comforter system that achieves the above object and that also provides draft protection to the feet of a person sleeping on the mattress.

It is another object of the present invention to provide a comforter system that achieves the above objects and that also provides enables thermoregulation of the person sleeping on the mattress.

The invention achieves the above objects, as well as other objects and advantages that will become apparent from the description that follows, by providing a comforter system and use thereof. The system has a comforter sheet. In some embodiments, the comforter sheet includes a shell containing insulative filling. The comforter sheet has a foot-end portion that defines a pouch. In some embodiments, the pouch is elastic. The pouch is configured to receive a foot-end portion of a mattress and thus selectively couple the comforter to the mattress. Accordingly, the pouch facilitates preventing misalignment of the comforter relative to the mattress while providing draft protection to feet of a person sleeping on the mattress.

In some embodiments, the pouch is defined by only the foot-end portion of the comforter sheet. In some embodiments, the comforter has a head-end portion that is not configured to couple to the mattress.

In some embodiments, the pouch is configured to selectively transition between a comforter extension configuration and a mattress coupling configuration. In the comforter extension configuration, the pouch does not couple the comforter to the mattress. In the mattress coupling configuration, the pouch is able to couple the comforter to the mattress.

In some embodiments, a tensioner is coupled to a portion the comforter sheet, such as the foot-end portion. A tension adjuster is preferably coupled to the tensioner. In some embodiments, increasing the tension along the tensioner transitions the pouch from the comforter extension configuration to the mattress coupling configuration, while decreasing the tension along the tensioner transitions the pouch from the mattress coupling configuration to the comforter extension configuration.

In some embodiments, the foot-end portion of the comforter sheet defines a channel, and the tensioner resides in the channel. The channel preferably extends along a perimeter of the foot-end portion of the comforter sheet. In some embodiments, the head-end portion of the comforter sheet is devoid of the tensioner.

In some embodiments, the system includes a top sheet that is configured to couple to a comforter, such as the comforter sheet. Accordingly, the top sheet coupling to the comforter facilitates preventing misalignment of the top sheet relative to the comforter.

In some embodiments, one or both of the head-end portion or the foot-end portion of the top sheet defines a respective comforter-retention pouch. Such pouch is preferably configured to selectively receive the corresponding end portion of a comforter.

In some embodiments, the comforter has an upper surface that faces away from the mattress when properly placed on the mattress, and the top sheet has a top surface that also faces away from the mattress properly placed on the mattress. The upper surface of the comforter preferably has a coupler, and the top surface of the top sheet also preferably has a coupler that is configured to couple to the coupler of the comforter. In some embodiments, one of the couplers includes a toggle button, and the other of the couplers includes a loop that is configured to receive the toggle button

BRIEF DESCRIPTION OF THE DRAWINGS

The preferred embodiments of the present invention are described in detail below with reference to the following drawings.

DETAILED DESCRIPTION OF THE PREFERRED EMBODIMENT

A comforter system in accordance with the principles of the invention is generally indicated at reference number 22 in the Figures of the attached drawings, wherein numbered elements in the Figures correspond to like numbered elements herein.

Figure 1:
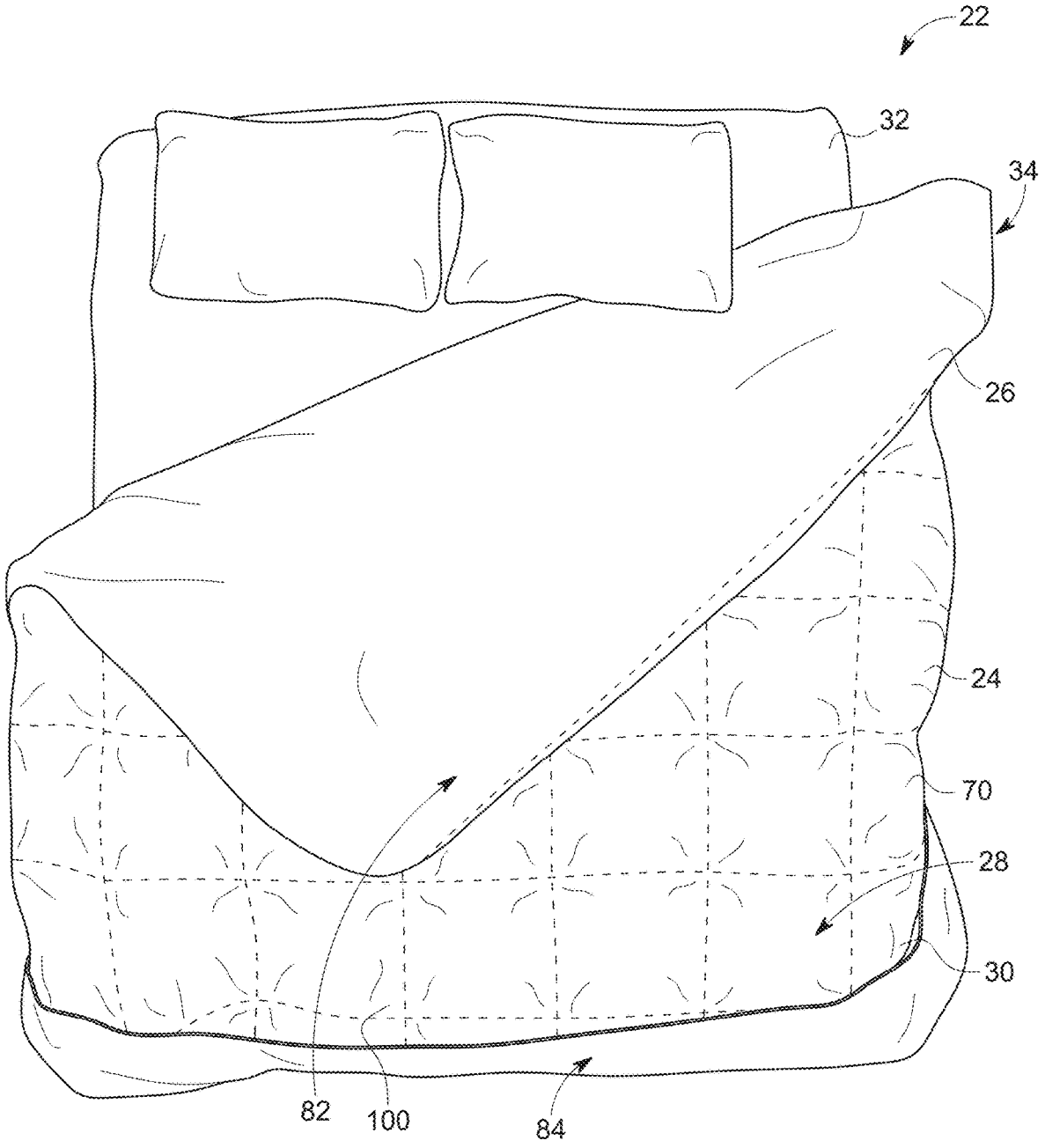
FIG. 1 is a top view of a preferred comforter system, including a comforter on a mattress.
Figure 2:
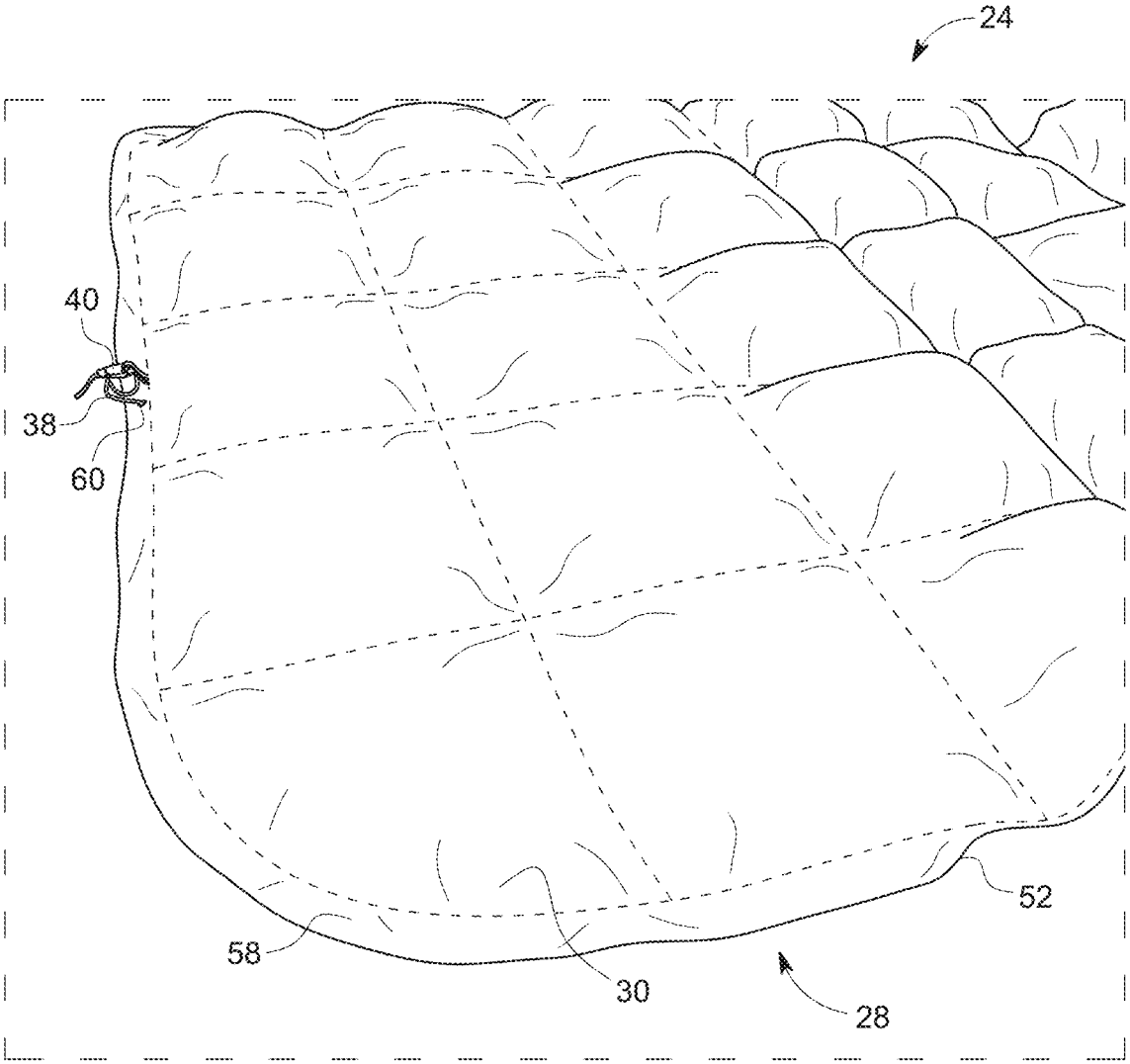
FIG. 2 is a perspective view of the comforter of the comforter system of FIG. 1 with a pouch in a comforter extension configuration.
Figure 3:
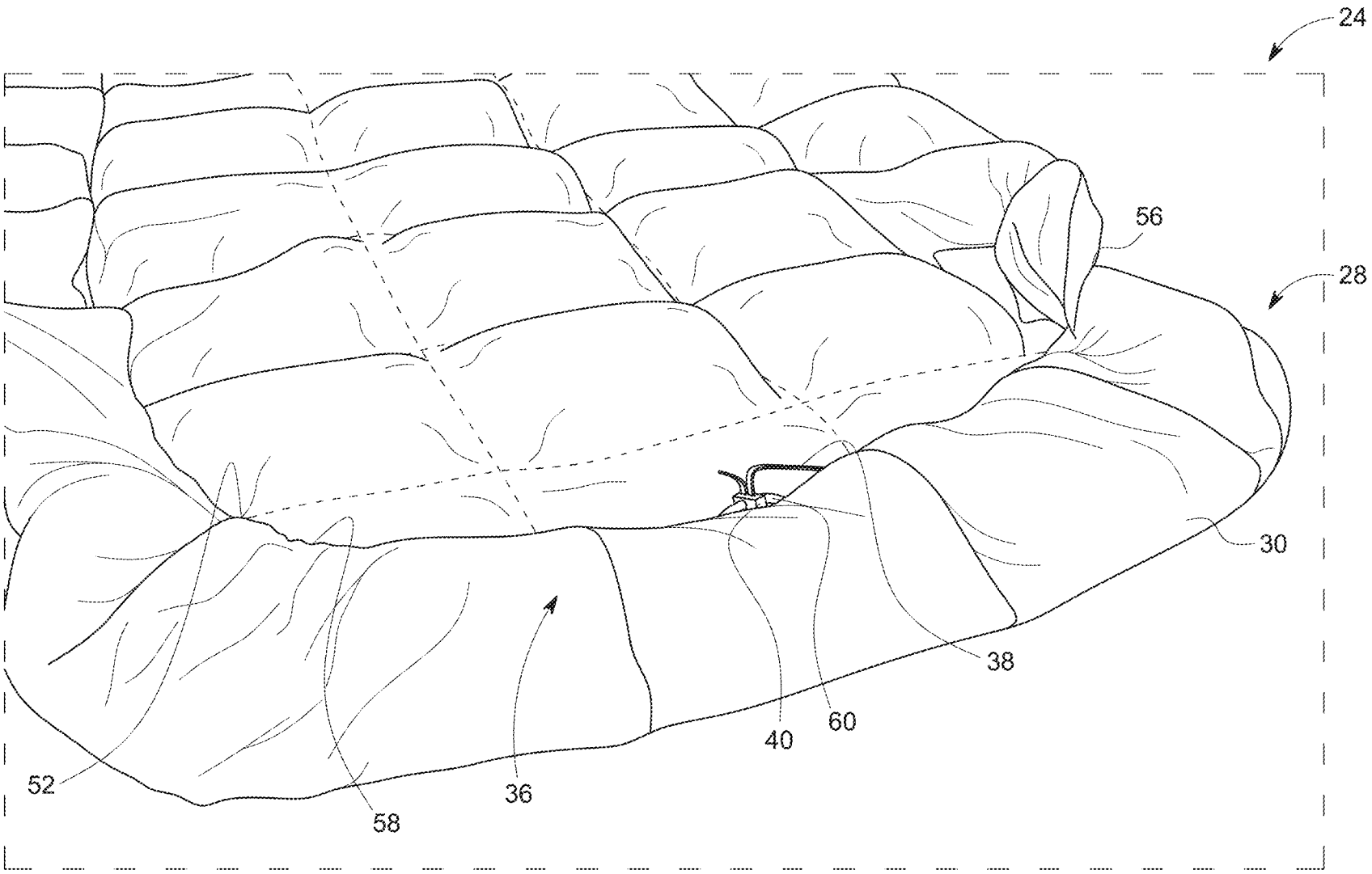
FIG. 3 is a perspective view of the comforter of FIG. 2 with the pouch in a mattress coupling configuration and the comforter flipped upside down to show a foot box provided by the pouch in the mattress coupling configuration.
Figure 4:
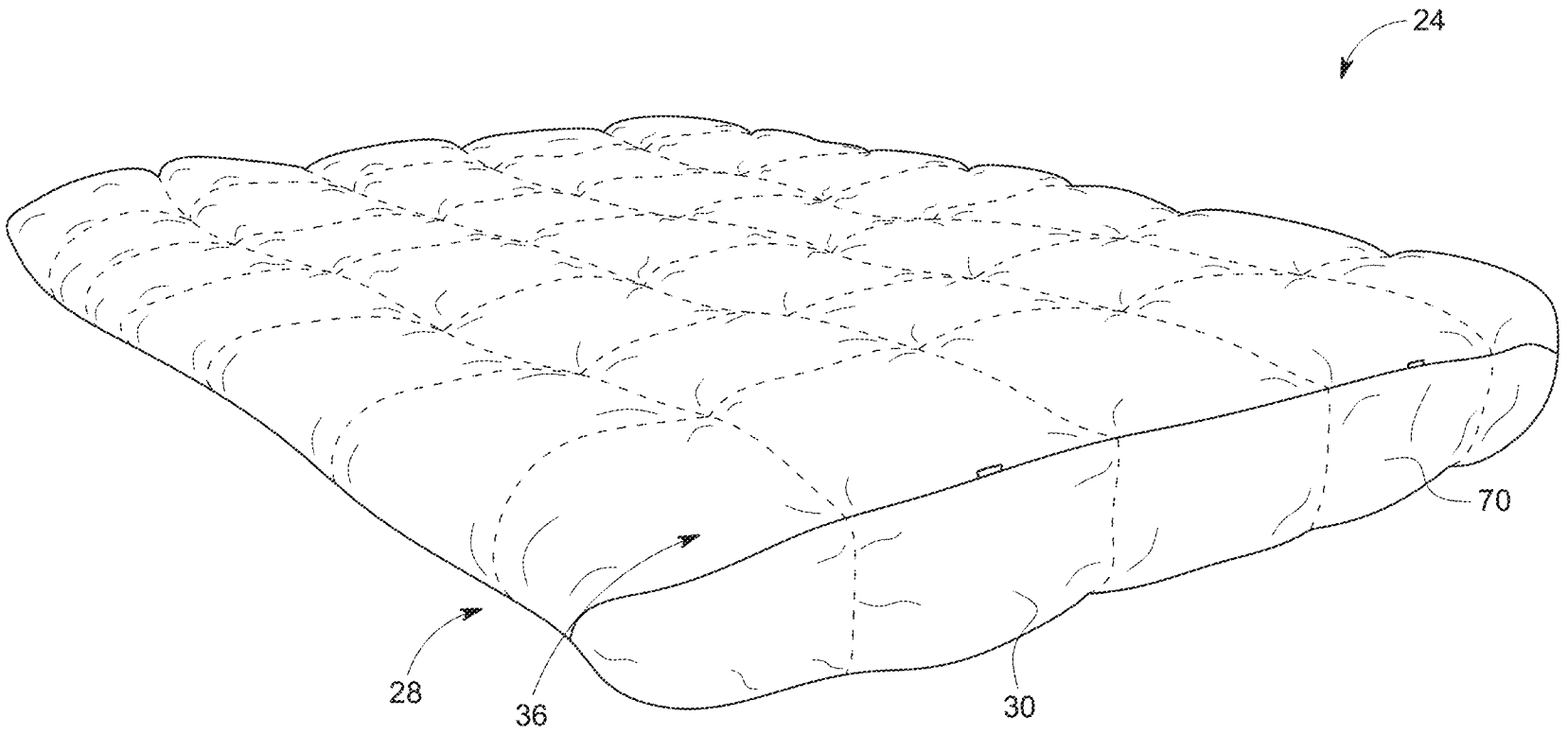
FIG. 4 is a perspective view of the comforter of FIG. 2 coupled to a mattress received in the pouch.

As shown in FIG. 1, the comforter system 22 includes a comforter 24 and, in some embodiments, a top sheet 26. As shown in FIGS. 2-4, the foot-end portion 28 of the comforter 24 defines an elastic pouch 30 that is configured to receive a foot-end portion (not shown) of a mattress, such as the mattress 32 in FIG. 1, to couple the comforter 24 to the mattress. As shown in FIG. 1, the top sheet 26 is configured to couple to the comforter 24. Accordingly, the comforter system 22 facilitates preventing misalignment of the comforter 24 relative to the mattress 32, as well as preventing misalignment of the top sheet 26 relative to the comforter 24.

As seen by contrasting FIG. 2 with FIG. 3, the foot-end portion 28 of the comforter 24 is disposed opposite from a head-end portion 34 of the comforter 24 (see FIG. 1) and is configured to transition between functioning as a normal comforter (i.e., a comforter extension configuration as shown in FIG. 2) and engaging with the foot-end portion of a mattress with a cinched footbox 36 (i.e., a mattress coupling configuration as shown in FIG. 3, the comforter shown upside-down) provided by the pouch 30 nesting over the top of the mattress. In the mattress coupling configuration, the comforter 24 is configured to receive a mattress in the pouch 30 as shown in FIG. 4.

As shown in FIGS. 2-4, the pouch 30 is limited to the foot-end portion 28 of the comforter 24. The head-end portion 34 of the comforter 24, in contrast, is free to move relative to the mattress regardless of whether the pouch is in the comforter extension configuration or the mattress coupling configuration. Accordingly, when coupled to a mattress, the comforter 24 provides the footbox 36 that provides draft protection to the feet of the occupants of the bed while the pouch 30 wraps around the mattress to reduce drafts at the feet while holding the comforter 24 in place during use. Also when coupled to the mattress, the comforter 24 permits thermoregulation of the occupants sleeping on the mattress by enabling the head-end portion 34 of the comforter 24 to be pushed down or folded back as shown in FIG. 1 or otherwise allowing glabrous skin (e.g., hands and feet) to be extended out from under the comforter 24 to be exposed to external environmental air and thereby reduce body temperature as desired for the occupants, without the mattress from the pouch 30 in the mattress coupling configuration.

Figure 5:
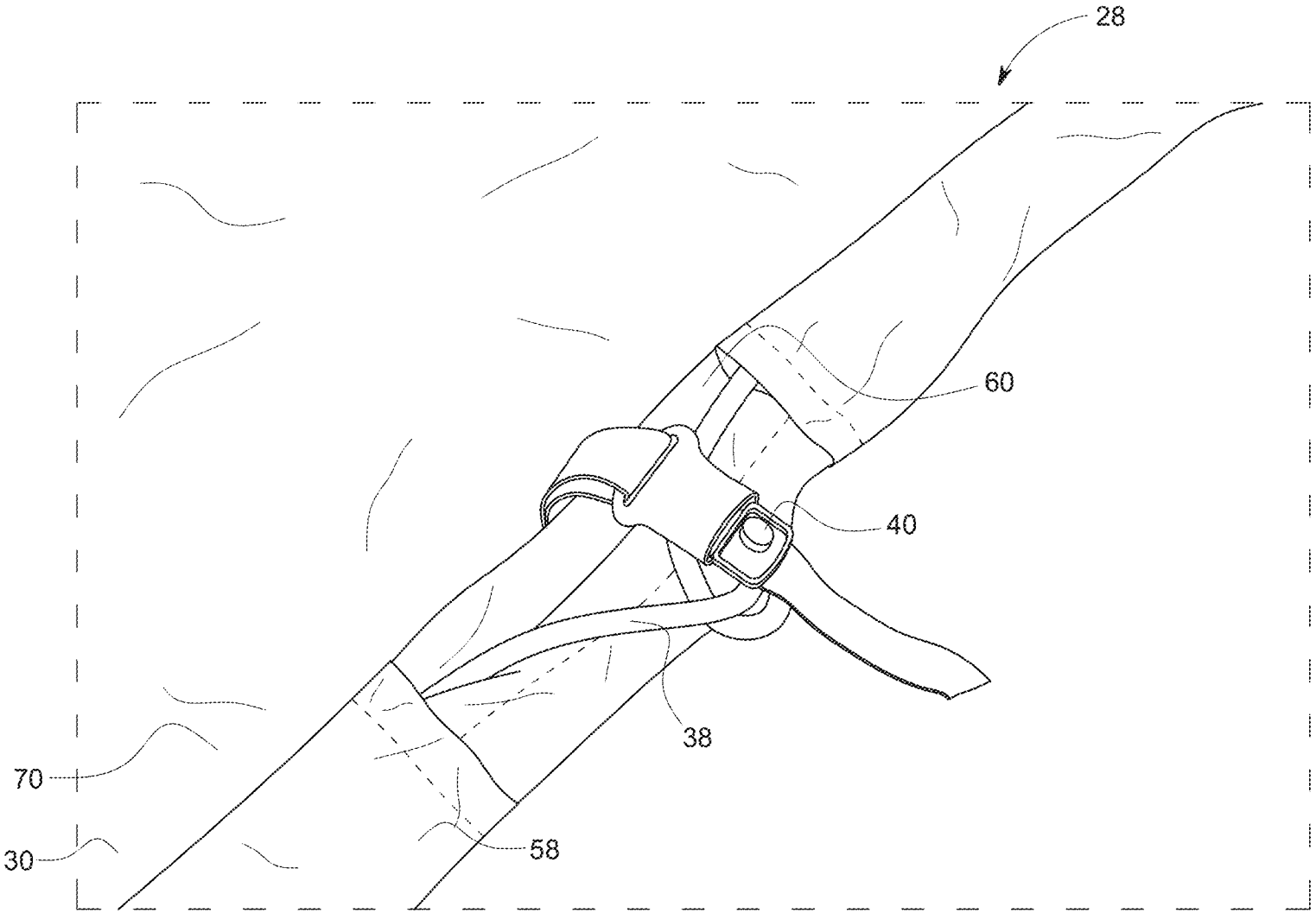
FIG. 5 is a perspective view of a close-up portion of the comforter of FIG. 2 showing a tensioner and tension adjuster.
Figure 6:
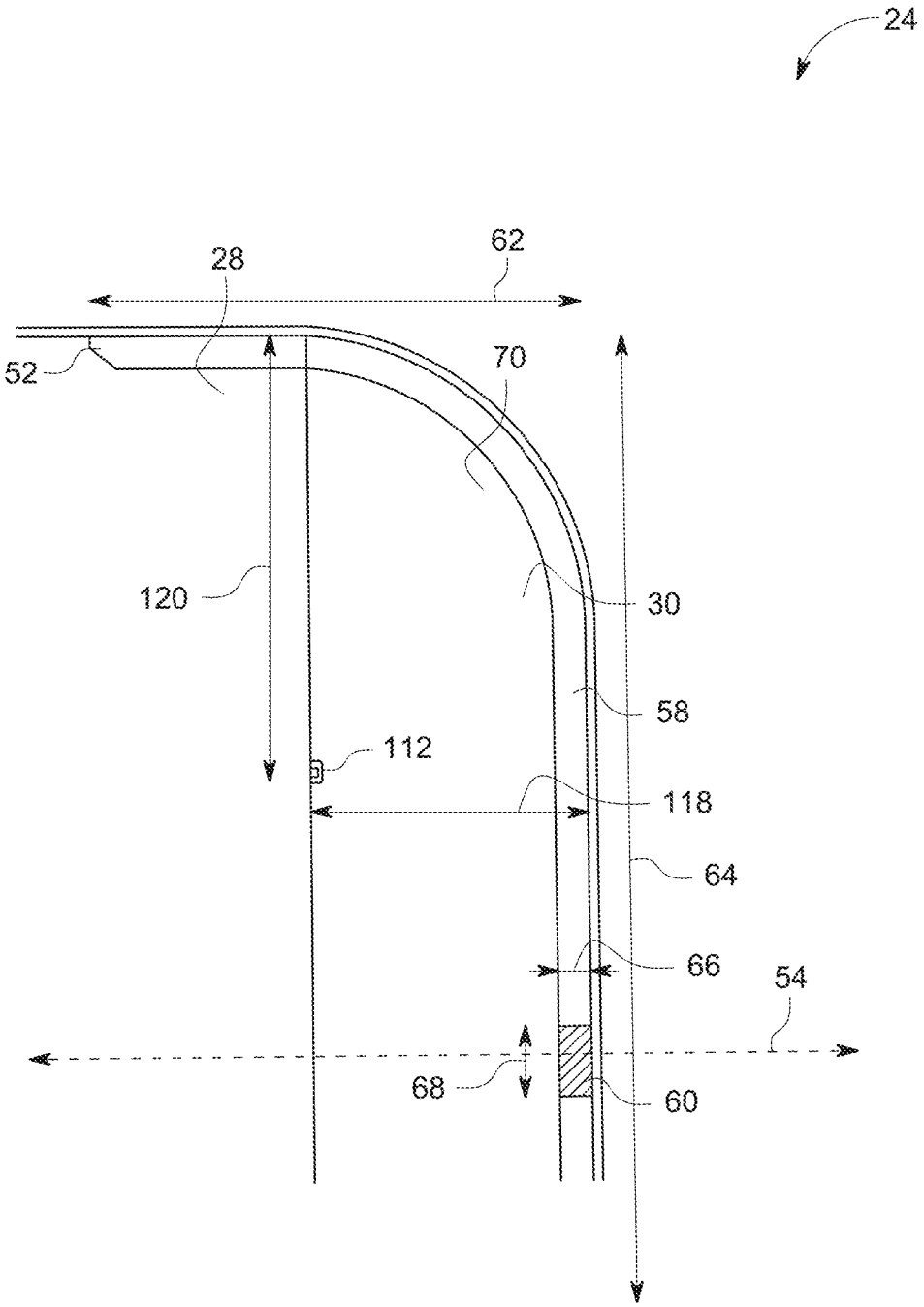
FIG. 6 is a schematic representation of a portion of a foot-end portion of the comforter of FIG. 2, showing a channel in which a portion of the tensioner resides.

In some embodiments, a tensioning system enables transitioning the pouch 30 between the comforter extension configuration and the mattress coupling configuration. The tensioning system includes at least one tensioner, such as the tensioner 38, and a tension adjuster, such as the tension adjuster 40, as shown in FIG. 5. In some embodiments, the tensioner 38 includes a single elastic cord that attaches to the foot-end portion 28 of the comforter 34 at two locations. In other embodiments, the tensioner 38 includes two elastic cords that each attach to the foot-end portion 28 of the comforter 34 at a respective one of the locations. As shown in FIG. 6, one attachment location 52 is disposed at a forward end portion of the perimeter of the foot-end portion 28 of the comforter 24. In some embodiments, the comforter 24 is symmetric about its longitudinal axis 54, and the other of such attachment locations 56 is therefore disposed at the other forward end portion 28 of the comforter 24, as shown in FIG. 3.

The tension adjuster 40 enables increasing the tension between the anchor locations 52, 56 and the tension adjuster 40 along the tensioner 38, thereby transitioning the pouch 30 from the comforter extension configuration to the mattress coupling configuration. The tension adjuster 40 also preferably enables decreasing the tension between the anchor locations 52, 56 and the tension adjuster 40 along the tensioner 38, thereby transitioning the pouch 30 from the mattress coupling configuration to the comforter extension configuration. The middle portion of the tensioner 38 in embodiments having a single elastic cord (or the opposite from nonattached end portions of the tensioner 38 in embodiments having multiple elastic cords) extends through the tension adjuster 40, as shown in FIGS. 2, 3, and 5. The foot-end portion 28 of the comforter 24 preferably defines a channel 58 that, in some embodiments, extends along the perimeter of the foot-end portion 28, as shown in FIG. 2. In some embodiments, the channel is defined by a tubular sleeve structure, and the tensioner 38 extends from the anchor locations 52, 56 through the channel 58 to the tension adjuster 40. In some embodiments, the tension adjuster 40 is disposed substantially in or within the proximity of an opening 60 in the channel defined by the foot-end portion 28 of the comforter 24. In some embodiments, the tension adjuster 40 includes a cord lock adjuster, such as a spring-loaded cord lock adjuster. Accordingly, pulling the tensioner 38 through the tension adjuster 40 increases the tension along the tensioner 38 and reduces the effective length of the tensioner 38, thereby transitioning the pouch 30 from the extended comforter configuration to the mattress coupling configuration. Conversely, releasing the lock by the tension adjuster 40 on the tensioner 38 (such as by depressing a button on the tension adjuster 40) decreases the tension along the tensioner 38 and increases the effective length of the tensioner 38, thereby transitioning the pouch 30 from the mattress coupling configuration to the extended comforter configuration.

As shown in FIG. 6, the length 62 of the foot-end portion 28 of the comforter 24 is preferably approximately 50 cm. Accordingly, the length 62 creates the pouch 30 to hold the comforter 24 on the mattress while also allowing thermo-regulation by pulling the comforter back from the top or allowing a foot to exit the comforter during the night while the occupants sleep because the pouch 30 does not extend along the entire length of the comforter 24 and preferably along only a minority of the length of the comforter 24, such as approximately 22% of the length of the comforter 24. The length of the comforter 24 is preferably approximately 88 inches. In embodiments where the comforter 24 is configured as a single occupant comforter, the width 64 of the foot-end portion 28 of the comforter 24 is preferably approximately 58 inches. In embodiments where the comforter 24 is configured as a double occupant comforter, the width 64 is preferably approximately 80 inches. The diameter 66 of the channel 58 is preferably approximately 3.25 cm. The width 68 of the opening 60 in the channel 58 is preferably approximately 7 cm. The comforter 24 preferably includes a comforter sheet 70 that preferably has a comforter shell containing insulative filling, such as down.

In other embodiments, the tensioner 38 is not anchored at one or more of the locations 52, 56 and is instead anchored at another location such as the middle of the channel 58 with the tension adjuster 40 being disposed substantially at one or more of the locations 52, 56, thereby enabling an occupant of the bed to adjust the tension along the tensioner 38 while lying between the comforter 24 and the mattress. In other embodiments, an extension strap or lead line may extend from the tensioner 38 to promote ease of tightening without reaching the tension adjuster 40.

Figure 7:
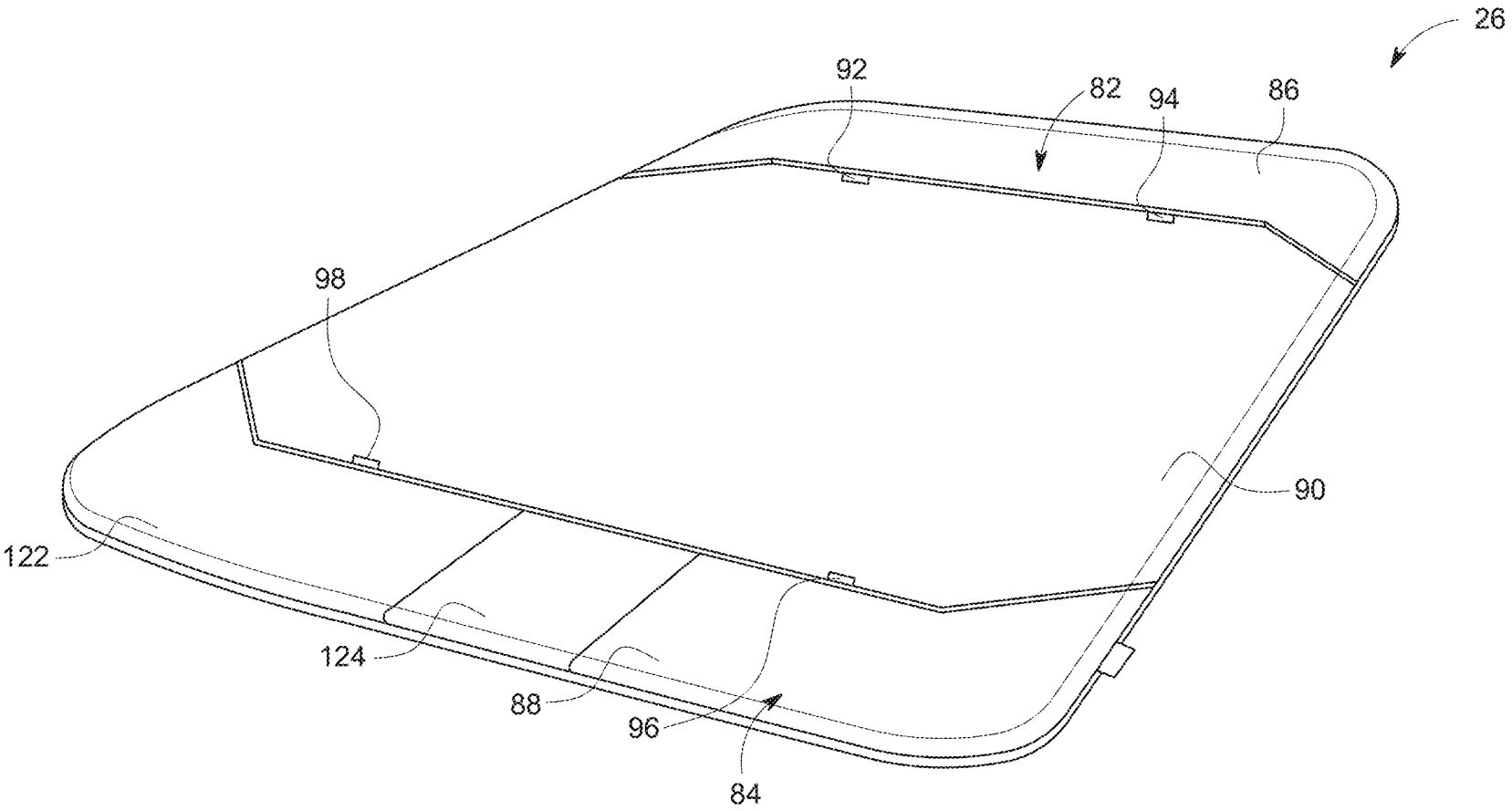
FIG. 7 is a perspective view of the top sheet of the comforter system of FIG. 1.

As shown in FIG. 1, the top sheet 26 is configured to couple to the comforter 24 to prevent misalignment of the top sheet 26 relative to the comforter 24. As shown in FIG. 7, the top sheet 26 has a head-end portion 82 and a foot-end portion 84 disposed opposite from the head-end portion 82. In some embodiments, one or more of the head-end portion 82 or the foot-end portion 84 of the top sheet 26 defines a respective comforter-retention pouch, such as the comforter-retention pouch 86 defined by the head-end portion 82 or the comforter-retention pouch 88 defined by the foot-end portion 84. At least one of the retention pouches 86, 88 is configured to receive a portion of the comforter 24, thereby selectively coupling the top sheet 26 to the comforter 24. As shown in FIG. 1, the head-end portion 34 of the comforter 24 can be selectively inserted into the pouch 86 at the head-end portion 82 of the top sheet 26, and in some embodiments, the foot-end portion 28 of the comforter 24 can be selectively inserted into the pouch 88 at the foot-end portion 84 of the top sheet 26 before or after transitioning the comforter 24 into the mattress coupling configuration. In particular, the cinched footbox 36 of the comforter 24 cooperatively 26 to tuck a portion of foot-end portions 84, 28 of the top sheet 26 and the comforter 24 alone the mattress, regardless of whether further coupling mechanisms are utilized.

In some embodiments, the top sheet 26 has further mechanisms for coupling to the comforter 24. As shown in FIG. 7, the top surface 90 of the top sheet 26 has one or more couplers, such as male couplers such as the toggle buttons 92, 94, 96, and 98, that are configured to couple to the upper surface 100 of the comforter 94. The couplers on the top surface of the top sheet 26 are preferably disposed along the edges of the comforter-retention pouches 86, 88 to facilitate coupling to the upper surface 100 of the comforter 94 after the comforter 94 is received in those pouches 86, 88. In particular, the upper surface 100 of the comforter 24 preferably has a coupler for each of the couplers on the top surface 90 of the top sheet 26 at a respective location on the upper surface 100 of the comforter 24 that substantially matches the location of a respective one of the couplers on the top surface 90 of the top sheet 26 when the top sheet 26 is coupled to the comforter 24.

Figure 8:
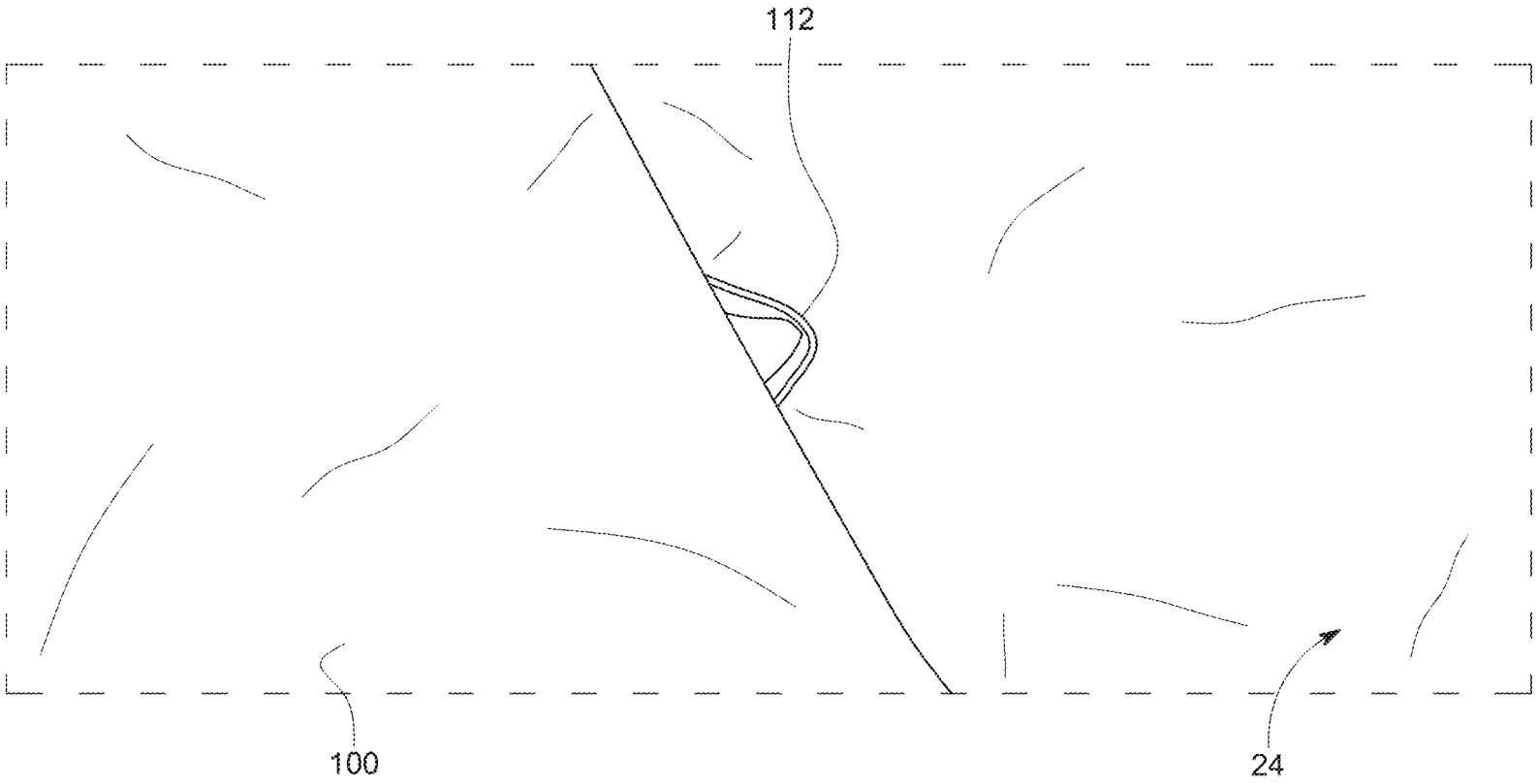
FIG. 8 is a perspective close-up view of a top surface of the comforter of FIG. 2 having a loop configured to couple the top sheet of FIG. 7 to the comforter.
Figure 9:
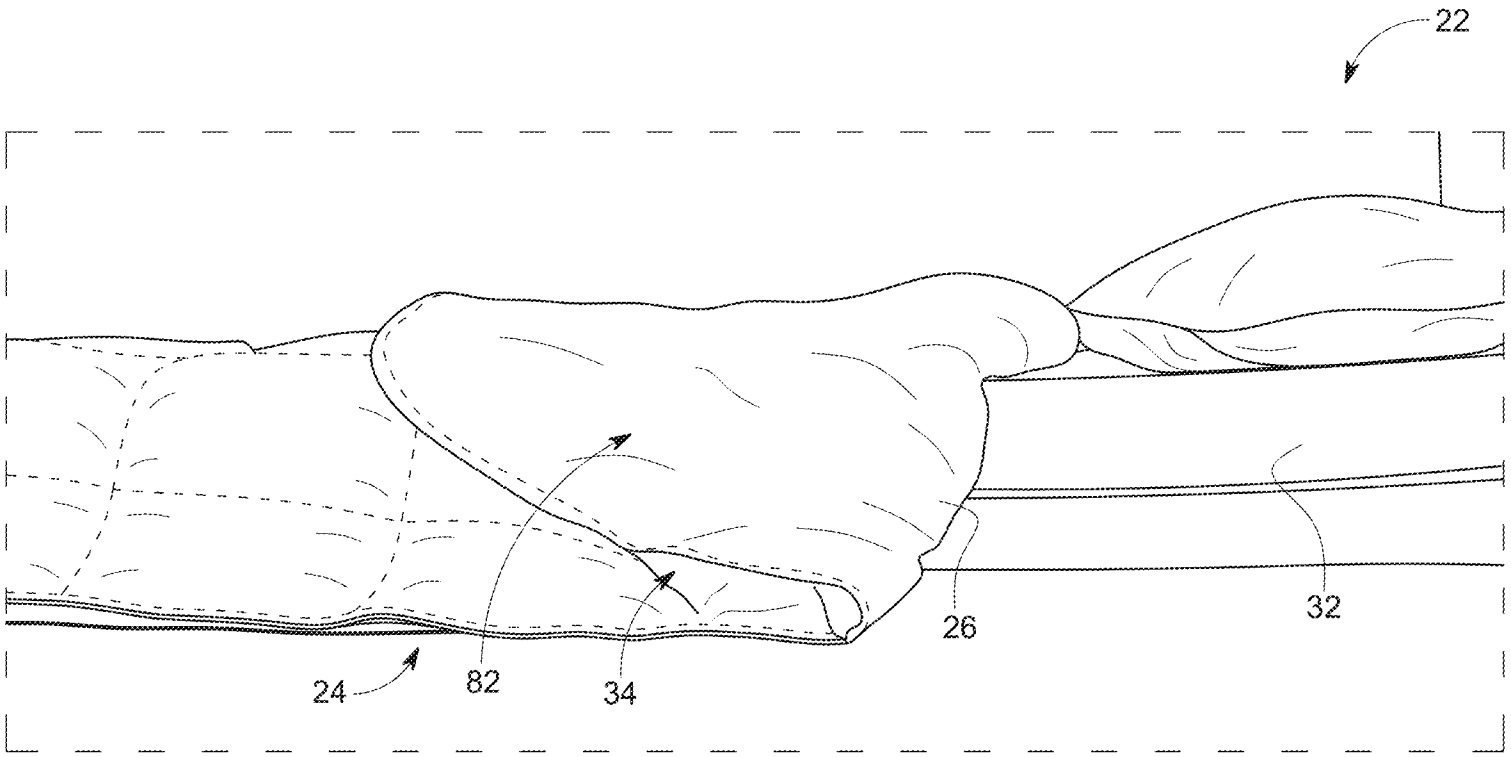
FIG. 9 is a perspective view of the top sheet of FIG. 7 coupled to the comforter of FIG. 2.

As shown in FIG. 8, the couplers on the upper surface 100 of the comforter 24 preferably include female couplers, such as loops such as the loop 112 (only one shown), that are configured to receive a respective 1 of the toggle buttons 92-98. Accordingly, after the head-end portion 34 of the comforter 24 is inserted into the comforter-retention pouch 86 of the top sheet 26, the toggle buttons 92, 94 can be inserted through the respective loops on the upper surface 100 of the head-end portion 34 of the comforter 24, thereby securing the head-end portion 34 of the comforter 24 in the comforter-retention pouch 86 of the top sheet 26, as shown in FIG. 9. After the foot-end portion 28 of the comforter 24 is inserted into the comforter retention pouch 88 of the top sheet 26, the toggle buttons 96, 98 can be inserted through the respective loops on the upper surface 100 of the foot-end portion 28 of the comforter, thereby securing the foot-end portion 28 of the comforter 24 and the comforter-retention pouch 88 of the top sheet 26, including when the pouch 30 of the comforter 24 is coupled to the mattress in the mattress coupling configuration, as shown in FIG. 1. Accordingly, the couplers are disposed opposite the comforter 24 from the occupants of the bed, thereby preventing the couplers from disrupting the sleep or comfort of the occupants.

The couplers on the top surface 90 of the top sheet 26 and the upper surface 100 of the comforter 24 are positioned so as to allow the top sheet 26 to wrap around the head and foot edges of the comforter 24 and thereby maintain the top sheet 26 positioned between the occupants of the bed and the comforter 24 for cleanliness and comfort. Accordingly, coupling the top sheet 26 maintains the cleanliness of the comforter 24, including from limbs that extend over the edges of the comforter 24, while enabling simple detachment of the top sheet 26 from the comforter 24 to promote washing the top sheet 26. The top sheet 26 thus provides the functions of a duvet cover that is easier to use than a standard duvet cover because it is easier to clean and remove from the comforter 24. The top sheet 26 may also be used with other types of comforters that lack pouches or tensioners that facilitate coupling the comforter to a mattress, such a standard comforters.

In some embodiments, the toggle buttons 92-98 are each coupled to the top sheet 26 with respective attachment cords, as shown in FIG. 7. In other embodiments, the couplers on the upper surface 100 of the comforter 24 include male couplers such as toggle buttons while the couplers on the top surface 90 of the top sheet 26 include female couplers such as loops.

Figure 10:
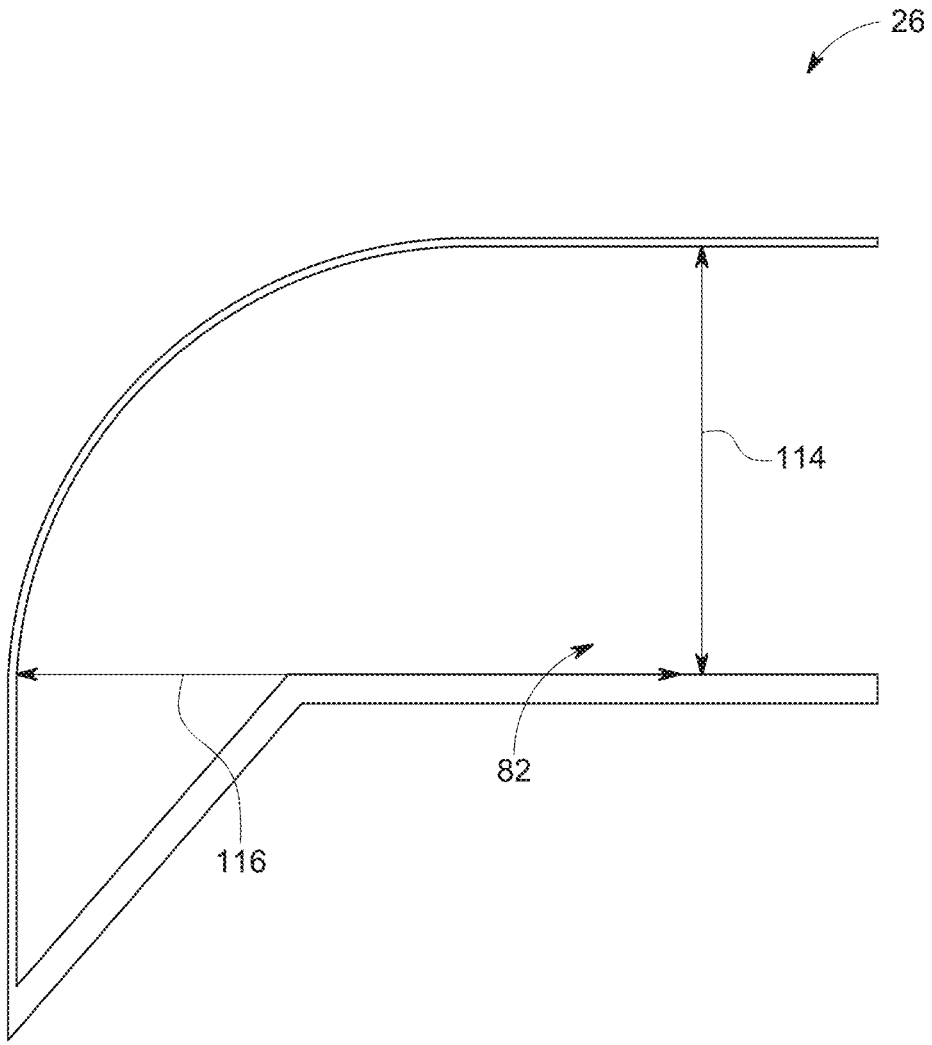
FIG. 10 is a schematic view of a pocket panel of the top sheet of FIG. 7 configured to receive the comforter of FIG. 2.

As shown in FIG. 10, each coupler on the top surface 90 of the top sheet 26 is disposed a distance 114 from the closer of the widthwise edges (i.e., the head edge or the foot edge) of the top sheet 26 of approximately 12 inches. Each coupler on the top surface 90 of the top sheet 26 is disposed a distance 116 from the closer of the lengthwise edges (i.e., the edges that connect the head-end portion 82 and the foot-end portion 84 to each other) of the top sheet 26 of approximately 47 cm. As shown in FIG. 6, the couplers disposed on the upper surface 100 of the comforter 24 are disposed a distance from the closer of the widthwise edges (i.e., the head edge or the foot edge) of the comforter 24 of approximately 24 cm. The couplers disposed on the upper surface 100 of the comforter 24 are disposed at distance from the closer of the lengthwise edges (i.e. the edges that connect the head-end portion 34 and the foot-end portion 28 to each other) of the comforter 24 of approximately 17.4 inches.

Figure 11:
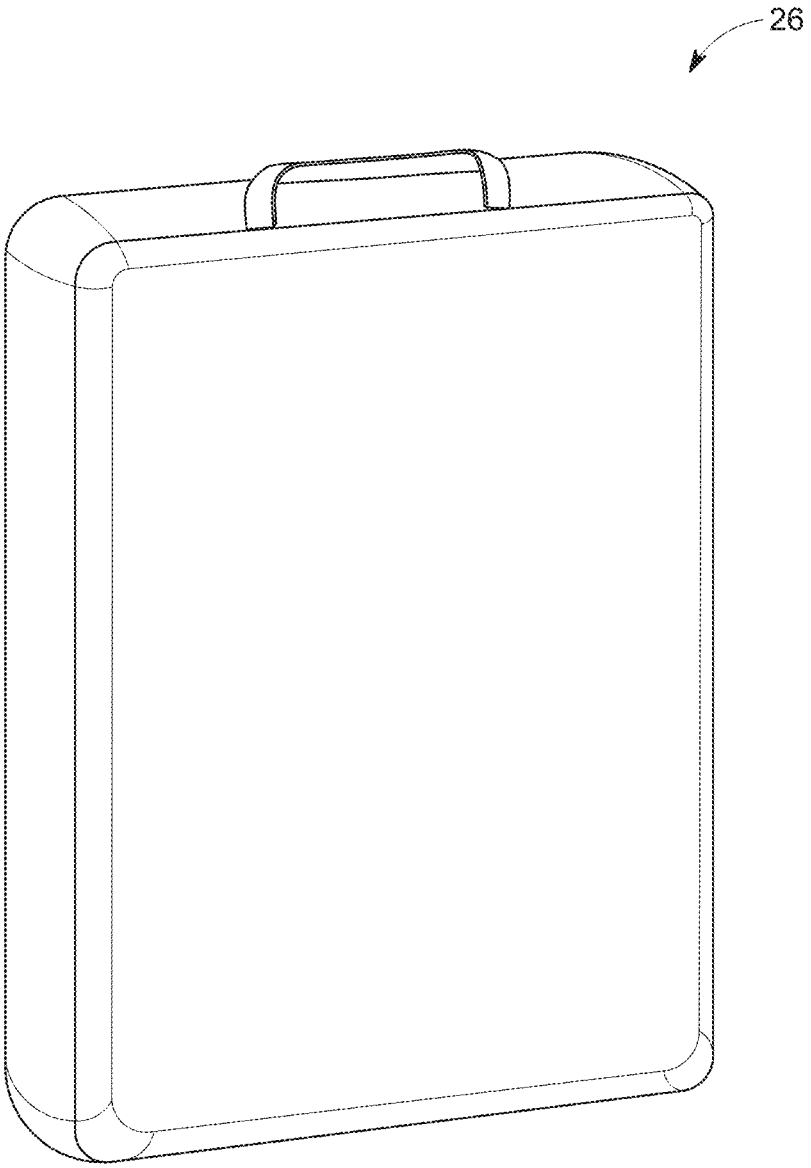
FIG. 11 is a perspective view of the top sheet of FIG. 7 in a stored configuration.

In some embodiments, the top wall of one of the comforter-retention pouches of the top sheet 26, such as the top wall 122 of the comforter-retention pouch 88, defines a stow pocket 124. In some embodiments, the top sheet 26 is configured to be folded into or otherwise collapsed into the stow pouch 124 for convenient stowage, such as in the container shown in FIG. 11.

Figure 12:
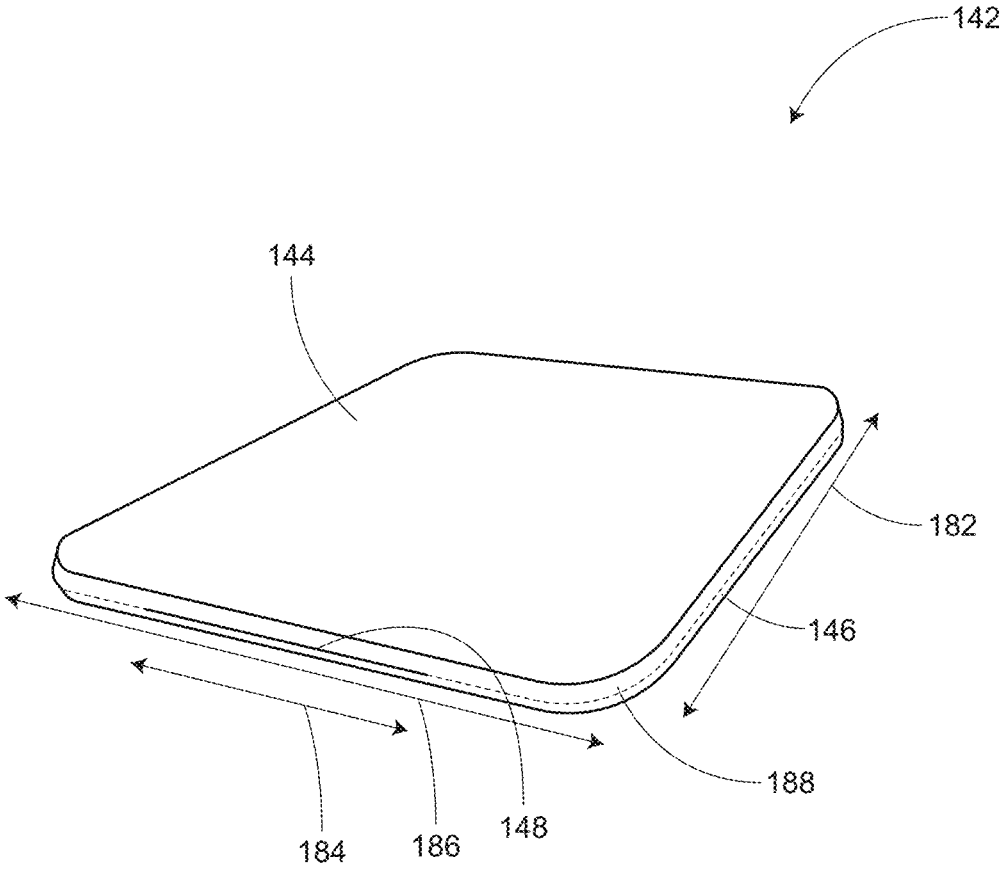
FIG. 12 is a perspective view of a duvet cover of the comforter system of FIG. 1.

As shown in FIG. 12, the comforter system 22 may include a duvet 142. In some embodiments, the duvet 142 has a top portion 144 and a bottom portion 146 between which the comforter 24 may be received through an opening 148. Once the comforter 24 is fully received in the duvet 142 and the corners of the comforter 24 extended to the corners of the duvet 142, the comforter 24 and duvet 142 may be placed on a mattress while the comforter 24 is utilized as discussed above. In particular, the comforter 24 inside the duvet 142 may transition between functioning as a normal comforter (i.e., a comforter extension configuration as shown in FIG. 2) and engaging with the foot-end portion of a mattress with a cinched footbox 36 (i.e., a mattress coupling configuration as shown in FIG. 3, the comforter shown upside-down) provided by the pouch 30 nesting over the top of the mattress. In such circumstances, the comforter 24 may therefore transition the duvet 142 between such configurations as well by operating as a normal duvet in the extension configuration or by being cinched between the foot-end portion of the comforter 24 and the mattress in the mattress coupling configuration. The duvet 142 may therefore be used with or without the top sheet 26 or any other sheet. The duvet may also be used without the comforter and may include a pouch at the foot-end thereof to engage with the foot end of the mattress for retention therewith. The duvet pouch may include an elastic (or non-elastic) tensioning member similar to that described above with regard to the comforter.

Figure 13:
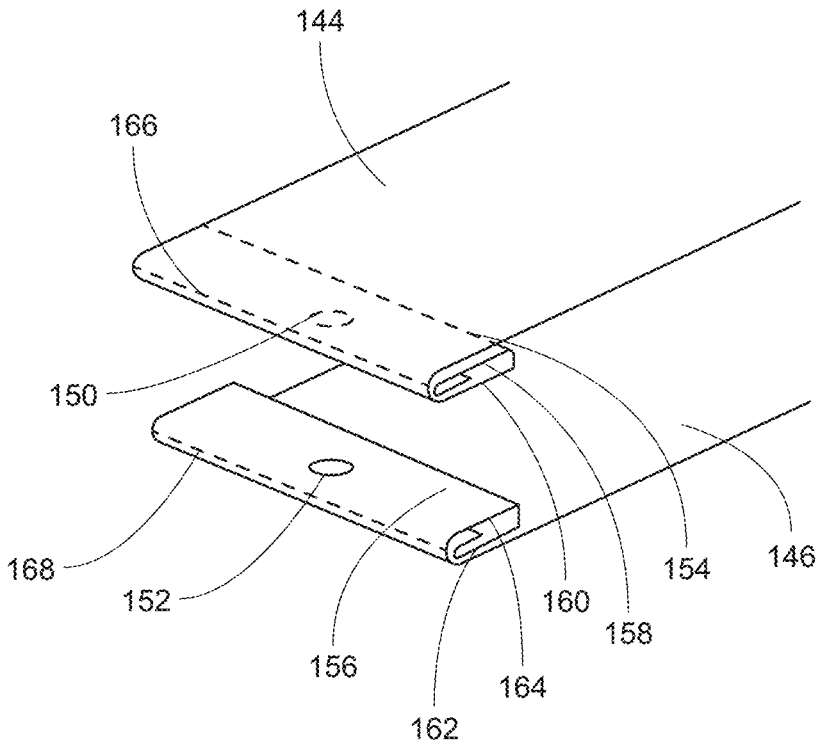
FIG. 13 is a perspective view of a cross-sectional view of a portion of the duvet cover of FIG. 12.

As shown in FIG. 13, the opening 148 has a plurality of couplers that enable transitioning the opening 148 between an open configuration in which the comforter 24 may be inserted into or removed from the duvet 142 (see FIG. 13) and a closed configuration in which the comforter 24 is retained in the duvet 142 (see FIG. 12). The couplers are preferably arranged to prevent them from contacting a user's skin while sleeping, as shown in FIG. 13. In particular, the upper fasteners, such as the fastener 150, may be disposed in a region of the foot-end portion of the top portion 144 of the duvet 142 that is folded under other regions of the top portion 144. Similarly, the lower fasteners, such as the fastener 152, may be disposed in a region of the foot-end portion of the bottom portion 146 of the duvet 142 that is folded over other regions of the bottom portion 146. Accordingly, the upper fasteners and lower fasteners face each other but, in the closed configuration, are shielded from a sleeper's skin by the outer regions of the top portion 144 and the bottom portion 146 of the duvet 142.

As shown in FIG. 13, a forward seam, such as the upper forward seam 154 (the lower forward seam not shown), holds the folded regions in place, such as the lower folded layers 156. Those regions include upper intermediate region 158, upper fastener region 160, lower intermediate region 162, and lower fastener region 164. In some embodiments, before the regions are folded and the seams created to hold the folded regions in place, the fasteners are coupled to the fastener regions 160, 164, which are disposed opposite the intermediate regions 158, 162 from the foot-end edges of the top and bottom portion 144, 146. After the regions are folded, two layers are disposed outside of the fastener regions 160, 164, as shown in FIG. 13, thereby increasing comfort of the sleeper. In some embodiments, rearward seams, such as the upper rearward seam 166 and the lower rearward seam 168, are also stitched in the respective upper and lower folded layers, as shown in FIG. 13 in addition to the forward seams, such as the upper forward seam 154.

As shown in FIG. 12, the length 182 of the duvet 142 is approximately 88 inches, in some embodiments. The width 184 of the opening 148 is preferably approximately 40 inches and preferably has approximately four upper fasteners and four lower fasteners that are equally spaced along the opening 148. In some embodiments, the outermost fasteners are spaced approximately 8 inches from the outermost edges of the opening 148 and the fasteners are each spaced approximately 8 inches from each other. In some embodiments, the width 186 of the duvet 142 is approximately 80 inches. The corners of the duvet 142 are preferably radiused with 11.5 inch radiuses in the corners in some embodiments. In some embodiments, the fasteners include snaps. In other embodiments, the fasteners include buttons and slots or loops, such as toggle buttons and loops. In some embodiments, an interior stow pocket (not shown) similar to that discussed above regarding the top sheet 26 is disposed between the top and bottom portions 144, 146 and stitched to one of such portions 144, 146. The pocket is preferably accessed through the opening 148, such that the duvet 142 may be stored in the pocket by turning it inside out.

As used herein, the following terms take the meanings explicitly associated herein, unless the context clearly dictates otherwise. The terms "upper," "lower," "above," "below," "top," "bottom," "topmost," and "bottom-most" are defined relative to vertical axis of a mattress laid out on a horizontal surface while an occupant lays on the mattress and the comforter 24 and the top sheet 26 are installed on such mattress as described herein. The vertical axis is non-parallel to the longitudinal axis and is defined as parallel to the direction of the earth's gravity force on the mattress when the mattress is on horizontal ground. The term "width" or "lateral" is defined relative to the lateral axis of the mattress with the mattress, comforter 24, and the top sheet 26 in such configuration. The lateral axis is non-parallel to the longitudinal and vertical axes. The length is measured along the longitudinal axis.

The term "foot-end portion" as used herein refers to the portion of the mattress, comforter, or top sheet disposed closest to the widthwise edge nearest to the occupant's feet when laying on the mattress with the comforter and top sheet installed thereon as described herein. The term "head-end portion" as used herein refers to the portion of the mattress, comforter, or top sheet disposed closest to the widthwise edge nearest to the occupant's head when laying on the mattress with the comforter and top sheet installed thereon as described herein. The foot and head-end portions are separated from each other by a middle portion that extends along the entire width of the mattress, comforter 24, or top sheet 26. The middle portion preferably defines a majority of the area and length of the mattress, comforter 24, or top sheet 26.

The term "configured" as used herein means an element being one or more of sized, dimensioned, positioned, or oriented to achieve or provide the recited function or result. The term "directly coupled" as used herein means that a component contacts (for example, when stitched) or is welded to another component. The term "indirectly coupled" as used herein means that a first component is coupled to a second component by way of one or more intervening components that are directly coupled to the first and second components. A first component that is indirectly coupled to a second component is directly coupled to a third component, which may be directly coupled to the second component or to a fourth component that is directly coupled to the second component. The term "coupled" should therefore be understood to disclose both direct and indirect coupling of components or elements that are described as being coupled to each other.

The term "substantially parallel" refers to parallel or within 5, 10, 15, or 20 degrees of parallel. The term "substantially orthogonal" refers to orthogonal or within 5, 10, 15, or 20 degrees of orthogonal. The term "substantially horizontal" or "substantially horizontally" refers to horizontal or within 5, 10, 15, or 20 degrees of horizontal. The term "substantially vertical" or "substantially vertically" refers to vertical or within 5, 10, 15, or 20 degrees of vertical. The term "approximately" or "substantially" refers to within 1, 5, 10, 15, or 20 percent of the identified value or range. The term "substantially in" or "within the proximity of" refers to being in or within 0.5, 1, 2, or 3 lengths of the identified subject from the referenced object, such as the tension adjuster 40 being within that many of its own lengths from the opening 60 in the channel 58 of the comforter 24.

The term "or" is an inclusive grammatical conjunction to indicate that one or more of the connected terms may be employed. For example, the phrase "one or more A, B, or C" or the phrase "one or more As, Bs, or Cs" is employed to discretely disclose each of the following: i) one or more As, ii) one or more Bs, iii) one or more Cs, iv) one or more As and one or more Bs, v) one or more As and one or more Cs, vi) one or more Bs and one or more Cs, and vii) one or more As, one or more Bs, and one or more Cs. The term "based on" as used herein is not exclusive and allows for being based on additional factors not described. The articles "a," "an," and "the" include plural references. Plural references are intended to also disclose the singular.

While the preferred embodiment of the invention has been illustrated and described, as noted above, many changes can be made without departing from the spirit and scope of the invention. Each disclosure of a component preferably having a feature or characteristic is intended to also disclose the component as being devoid of that feature or characteristic unless the principles of the invention clearly dictate otherwise. Accordingly, the scope of the invention is not limited by the disclosure of the preferred embodiment. Instead, the invention should be determined entirely by reference to the claims that follow. It should also be noted that the claim dependencies or combinations of elements recited in the claims do not reflect an intention to forgo claiming other subject matter disclosed herein. Instead, this disclosure is intended to also disclose the subject matter of any combination of any two or more of the claims, such that subsequent claim sets may recite that any one of the dependent claims depends from any other one or more claims, up to and including all other claims in the alternative (such as "The apparatus or method of any one of the preceding or subsequent claims . . . "). This disclosure is also intended to disclose the subject matter of any one of the dependent claims, as if it were an independent claim, with or without all or a portion of the subject matter of the original independent claim(s) or any other subject matter disclosed herein.

Those of ordinary skill in the art will conceive of other alternate embodiments of the invention upon reviewing this disclosure. Thus, the invention is not to be limited to the above description but is to be determined in scope by the claims that follow.

The invention claimed is:

1. A method of using a comforter system, the method comprising:

laying a comforter sheet on a mattress, the comforter sheet having a head-end portion and a foot-end portion disposed opposite from the head-end portion of the comforter sheet, the foot-end portion of the comforter sheet defining a pouch;

inserting a foot-end portion of the mattress into the pouch, whereby inserting the foot-end portion of the mattress into the pouch facilitates preventing misalignment of the comforter sheet relative to the mattress and further configures the comforter system so as to provide draft protection to feet of a person sleeping on the mattress, wherein inserting the foot-end portion of the mattress into the pouch includes transitioning the pouch from a comforter extension configuration to a mattress coupling configuration, the pouch in the comforter extension configuration being configured to not couple the comforter to the mattress, the pouch in the mattress coupling configuration being configured to couple the comforter to the mattress; and after transitioning the pouch from the comforter extension configuration to the mattress coupling configuration, transitioning the pouch from the mattress coupling configuration to the comforter extension configuration.

2. The method of claim 1, wherein the pouch is defined by only the foot-end portion of the comforter sheet, and the head-end portion does not define a pouch and is not configured to couple to the mattress.

3. The method of claim 1, wherein a tensioner is coupled to a portion of the foot-end portion of the comforter sheet, a tension adjuster is coupled to the tensioner, and transitioning the pouch from the comforter extension configuration to the mattress coupling configuration includes increasing tension along the tensioner between the foot-end portion of the comforter sheet and the tension adjuster.

4. The method of claim 3, further comprising:

laying the comforter sheet on the mattress while the comforter sheet is in the comforter extension configuration, wherein transitioning the pouch from the mattress coupling configuration to the comforter extension configuration includes decreasing the tension along the tensioner between the foot-end portion of the comforter sheet and the tension adjuster.

5. The method of claim 3, wherein the foot-end portion of the comforter sheet defines a channel in which the tensioner resides, the channel extending along a perimeter of the foot-end portion of the comforter sheet.

6. The method of claim 3, wherein the head-end portion is devoid of the tensioner.

7. The method of claim 1, further comprising:

before laying the comforter sheet on the mattress, laying a top sheet on the mattress; and coupling the top sheet to the comforter sheet, whereby the top sheet coupling to the comforter sheet facilitates preventing misalignment of the top sheet relative to the comforter sheet.

8. The method of claim 7, wherein the top sheet has a head portion and a foot portion disposed opposite from the head portion of the top sheet, the head portion of the top sheet defines a comforter-retention pouch, and coupling the top sheet to the comforter sheet includes inserting the head-end portion of the comforter sheet into the comforter-retention pouch.

9. The method of claim 7, wherein the comforter sheet has a bottom surface that faces the mattress when the foot-end portion of the mattress is inserted into the pouch, the top sheet has a top surface that faces away from the mattress when the top sheet is coupled to the comforter sheet and the bottom surface of the comforter sheet faces the mattress, the bottom surface of the comforter sheet has at least one of a toggle button or a loop, the top surface of the top sheet has at least one of the other of the toggle button or the loop, and coupling the top sheet to the comforter includes inserting the toggle button into the loop.

* * * * *